US007914649B2

(12) United States Patent
Ostendorf et al.

(10) Patent No.: US 7,914,649 B2
(45) Date of Patent: Mar. 29, 2011

(54) PAPERMAKING BELT FOR MAKING MULTI-ELEVATION PAPER STRUCTURES

(75) Inventors: Ward William Ostendorf, West Chester, OH (US); Rebecca Howland Spitzer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 662 days.

(21) Appl. No.: 11/925,000

(22) Filed: Oct. 26, 2007

(65) Prior Publication Data

US 2008/0245498 A1 Oct. 9, 2008

Related U.S. Application Data

(60) Provisional application No. 60/855,576, filed on Oct. 31, 2006.

(51) Int. Cl.
*D21F 1/10* (2006.01)

(52) U.S. Cl. ..... 162/348; 162/116; 162/362; 162/903; 428/156

(58) Field of Classification Search ..... 162/109–117, 162/361, 362, 348, 900, 902, 903; 428/152–156, 428/171, 172; 139/383 A
See application file for complete search history.

(56) References Cited

U.S. PATENT DOCUMENTS

| | | | |
|---|---|---|---|
| 1,536,533 | A | 5/1925 | Sheehan |
| 1,716,866 | A | 6/1929 | Sherman |
| 3,034,180 | A | 5/1962 | Greiner et al. |
| 3,240,657 | A | 3/1966 | Hynek |
| 3,301,746 | A | 1/1967 | Sandford et al. |
| 3,322,617 | A | 5/1967 | Osborne |
| 3,350,260 | A | 10/1967 | Johnson |
| 3,549,742 | A | 12/1970 | Benz |
| 3,834,983 | A | 9/1974 | Conway et al. |
| 3,994,771 | A | 11/1976 | Morgan, Jr. et al. |

(Continued)

FOREIGN PATENT DOCUMENTS

| | | |
|---|---|---|
| CA | 879436 | 8/1971 |

(Continued)

OTHER PUBLICATIONS

Exhibit D18, submitted Jul. 2, 2001 as "Non Patent Literature" cited during the appeal procedure for EPO 0631014 Opposition.

(Continued)

*Primary Examiner* — Eric Hug
(74) *Attorney, Agent, or Firm* — Roddy M. Bullock; Betty J. Zea

(57) ABSTRACT

A papermaking belt for making a fibrous structure having: a framework having: a first layer and a second layer, each of the first and second layers having a top surface, a bottom surface opposite to the top surface, and the first layer having a plurality of deflection conduits extending in the Z-direction between the top and bottom surfaces of the first layer and structured to receive therein fibers of the fibrous structure; the first layer comprising a substantially continuous, substantially discontinous or substantially semicontinuous patterned network; wherein the second layer comprises a plurality of discrete protuberances; and the top surface of the second layer forming the web-side of the framework; and a reinforcing element having: a paper facing side and a machine facing side opposite to the paper facing side; wherein the second layer at least partially penetrates the reinforcing element or the bottom surface of the second layer is coplanar with the bottom surface of the first layer.

31 Claims, 9 Drawing Sheets

U.S. PATENT DOCUMENTS

| | | | | | |
|---|---|---|---|---|---|
| 4,208,459 | A | | 6/1980 | Becker et al. | |
| 4,239,065 | A | | 12/1980 | Trokhan et al. | |
| 4,514,345 | A | | 4/1985 | Johnson et al. | |
| 4,528,239 | A | | 7/1985 | Trokhan | |
| 4,529,480 | A | | 7/1985 | Trokhan | |
| 4,541,895 | A | | 9/1985 | Albert | |
| 4,637,859 | A | | 1/1987 | Trokhan | |
| 4,740,409 | A | | 4/1988 | Lefkowitz | |
| 5,066,532 | A | | 11/1991 | Gaisser | |
| 5,077,116 | A | | 12/1991 | Lefkowitz | |
| 5,098,522 | A | | 3/1992 | Smurkoski et al. | |
| 5,245,025 | A | | 9/1993 | Trokhan et al. | |
| 5,260,171 | A | | 11/1993 | Smurkoski et al. | |
| 5,275,700 | A | | 1/1994 | Trokhan | |
| 5,328,565 | A | | 7/1994 | Rasch et al. | |
| 5,330,604 | A | | 7/1994 | Allum et al. | |
| 5,334,289 | A | | 8/1994 | Trokhan et al. | |
| 5,364,504 | A | | 11/1994 | Smurkoski et al. | |
| 5,429,686 | A | | 7/1995 | Chiu et al. | |
| 5,431,786 | A | | 7/1995 | Rasch et al. | |
| 5,462,642 | A | | 10/1995 | Kajander | |
| 5,496,624 | A | | 3/1996 | Stelljes et al. | |
| 5,500,277 | A | | 3/1996 | Trokhan et al. | |
| 5,514,523 | A | | 5/1996 | Trokhan et al. | |
| 5,527,428 | A | | 6/1996 | Trokhan et al. | |
| 5,529,664 | A | | 6/1996 | Trokhan et al. | |
| 5,549,790 | A | | 8/1996 | Phan | |
| 5,554,467 | A | | 9/1996 | Trokhan et al. | |
| 5,556,509 | A | | 9/1996 | Trokhan et al. | |
| 5,566,724 | A | | 10/1996 | Trokhan et al. | |
| 5,580,423 | A | | 12/1996 | Ampulski et al. | |
| 5,609,725 | A | | 3/1997 | Phan | |
| 5,614,061 | A | | 3/1997 | Van Phan et al. | |
| 5,624,790 | A | | 4/1997 | Trokhan et al. | |
| 5,628,876 | A | | 5/1997 | Ayers et al. | |
| 5,629,052 | A | | 5/1997 | Trokhan et al. | |
| 5,637,194 | A | | 6/1997 | Ampulski et al. | |
| 5,672,248 | A | | 9/1997 | Wendt et al. | |
| 5,674,663 | A | | 10/1997 | McFarland et al. | |
| 5,679,222 | A | * | 10/1997 | Rasch et al. | 162/358.1 |
| 5,693,187 | A | | 12/1997 | Ampulski et al. | |
| 5,709,775 | A | | 1/1998 | Trokhan et al. | |
| 5,714,041 | A | | 2/1998 | Ayers et al. | |
| 5,718,806 | A | | 2/1998 | Trokhan et al. | |
| 5,741,402 | A | | 4/1998 | Trokhan et al. | |
| 5,744,007 | A | | 4/1998 | Trokhan et al. | |
| 5,746,887 | A | | 5/1998 | Wendt et al. | |
| 5,776,311 | A | | 7/1998 | Trokhan et al. | |
| 5,795,440 | A | | 8/1998 | Ampulski et al. | |
| 5,804,036 | A | | 9/1998 | Phan et al. | |
| 5,804,281 | A | | 9/1998 | Phan et al. | |
| 5,814,190 | A | | 9/1998 | Phan | |
| 5,817,377 | A | * | 10/1998 | Trokhan et al. | 427/508 |
| 5,820,730 | A | | 10/1998 | Phan et al. | |
| 5,837,103 | A | | 11/1998 | Trokhan et al. | |
| 5,843,279 | A | | 12/1998 | Phan et al. | |
| 5,846,379 | A | | 12/1998 | Ampulski et al. | |
| 5,885,421 | A | | 3/1999 | Ensign et al. | |
| 5,893,965 | A | | 4/1999 | Trokhan et al. | |
| 5,895,623 | A | | 4/1999 | Trokhan et al. | |
| 5,900,122 | A | | 5/1999 | Huston | |
| 5,906,710 | A | | 5/1999 | Trokhan | |
| 5,948,210 | A | | 9/1999 | Huston | |
| 5,954,097 | A | | 9/1999 | Boutilier | |
| 5,972,813 | A | | 10/1999 | Polat et al. | |
| 6,017,417 | A | | 1/2000 | Wendt et al. | |
| 6,039,839 | A | | 3/2000 | Trokhan et al. | |
| 6,110,324 | A | | 8/2000 | Trokhan et al. | |
| 6,117,270 | A | | 9/2000 | Trokhan | |
| 6,149,849 | A | * | 11/2000 | Ampulski | 264/167 |
| 6,165,585 | A | | 12/2000 | Trokhan | |
| 6,194,847 | B1 | | 2/2001 | Hollaway | |
| 6,197,154 | B1 | | 3/2001 | Chen et al. | |
| 6,398,910 | B1 | | 6/2002 | Burazin et al. | |
| 6,420,100 | B1 | | 7/2002 | Trokhan et al. | |
| 6,436,240 | B1 | | 8/2002 | Jeffrey | |
| 6,464,831 | B1 | | 10/2002 | Trokhan et al. | |
| 6,576,090 | B1 | | 6/2003 | Trokhan et al. | |
| 6,576,091 | B1 | * | 6/2003 | Cabell et al. | 162/348 |
| 6,660,129 | B1 | | 12/2003 | Cabell et al. | |
| 7,094,320 | B1 | | 8/2006 | Phan | |
| 2001/0051224 | A1 | * | 12/2001 | Ampulski | 427/424 |
| 2005/0133176 | A1 | | 6/2005 | Vinson et al. | |
| 2006/0127641 | A1 | * | 6/2006 | Barnholtz et al. | 428/137 |

FOREIGN PATENT DOCUMENTS

| | | | |
|---|---|---|---|
| EP | 1217106 | | 6/2002 |
| GB | 1212473 | A | 11/1970 |
| GB | 2254288 | | 10/1992 |
| WO | WO 9114558 | | 10/1991 |
| WO | WO 92/00415 | A1 | 1/1992 |
| WO | WO 9914425 | | 3/1999 |
| WO | WO 00/39394 | A1 | 7/2000 |
| WO | WO 02/40769 | A2 | 5/2002 |

OTHER PUBLICATIONS

PCT International Search Report, mailed Aug. 5, 2008.

* cited by examiner

PAPERMAKING BELT FOR MAKING MULTI-ELEVATION PAPER STRUCTURES

CROSS REFERENCE TO RELATED APPLICATION

This application claims the benefit of U.S. Provisional Application No. 60/855,576 filed Oct. 31, 2006.

FIELD OF THE INVENTION

The present invention relates to a papermaking belt. In particular the present invention relates to a papermaking belt having multiple layers of a patterned framework, especially a papermaking belt for making strong, soft, absorbent fibrous structure paper webs.

BACKGROUND OF THE INVENTION

Paper products are a staple of every day life. Paper products are used as bath tissue, facial tissue, paper toweling, napkins, etc. Typically, such paper products are made by depositing an aqueous slurry of cellulosic fibers from a headbox onto one or more papermaking belts. The aqueous carrier is removed, leaving the cellulosic fibers to form an embryonic web which is dried to form a paper sheet. The cellulosic fibers may be dried with press felts, by through air drying or by any other suitable means. The large demand for such paper products has created a demand for improved versions of these products.

Important characteristics of these products include strength, softness, and absorbency. Strength is the ability of a paper web to retain its physical integrity during use. Softness is the pleasing tactile sensation consumers perceive when they use the paper for its intended purposes. Absorbency is the characteristic of the paper that allows the paper to take up and retain fluids, particularly water and aqueous solutions and suspensions.

Absorbency of a fibrous structure may dependent on its surface area. That is, in some cases, the greater the web's surface area the higher the web's absorbency. Therefore, providing paper webs having lower density areas that are dispersed throughout the web, may increase the web's surface area and hence absorbency. These lower density areas may also increase the web's bulk and softness. However, increasing the web's surface area by increasing the number of lower-density areas on the web, may decrease the web's strength. Therefore, there is a need to properly adjust the density, surface area, and basis weight of the web, which may be accomplished, for example, through the proper selection of papermaking belts.

Therefore, the present invention provides further improved paper characteristics, for example improved absorbency, caliper, bulk, and/or softness. The papermaking belt of the present invention improves product characteristics by optimizing the imprinting surface of the papermaking belt by balancing the surface area of the imprinting surface of the belt with the area, shape, and/or size of the deflection conduits. The present advantages are accomplished by providing a papermaking belt with multiple framework layers to serve as the imprinting surface of the papermaking belt. The multiple framework layers further modify the high density region of the paper made therewith. With the present invention this modification of the imprinting surface of the belt, is balanced versus the size and orientation of the deflection conduits, responsible for the relatively lower density regions of the web. This invention therefore, minimizes the trade-off between the surface area of the high-density network region primarily providing strength, and the surface area of the low-density region primarily providing softness and absorbency. The present invention also provides processes for making the papermaking belt of the present invention.

SUMMARY OF THE INVENTION

In one embodiment the present invention relates to a papermaking belt for making a fibrous structure comprising:

an X-Y plane, and a thickness extending in a Z-direction perpendicular to the X-Y plane;

a framework comprising:

a first layer and a second layer, each of the first and second layers having a top surface, a bottom surface opposite to the top surface, and the first layer having a plurality of deflection conduits extending in the Z-direction between the top and bottom surfaces of the first layer and structured to receive therein fibers of the fibrous structure; the first layer comprising a substantially continuous, substantially discontinous or substantially semicontinuous patterned network;

wherein the second layer comprises a plurality of discrete protuberances; and the top surface of the second layer forming the web-side of the framework;

a reinforcing element comprising:

a paper facing side and a machine facing side opposite to the paper facing side;

wherein the second layer at least partially penetrates the reinforcing element or the bottom surface of the second layer is coplanar with the bottom surface of the first layer.

DETAILED DESCRIPTION OF THE INVENTION

Definitions

Figure 1:
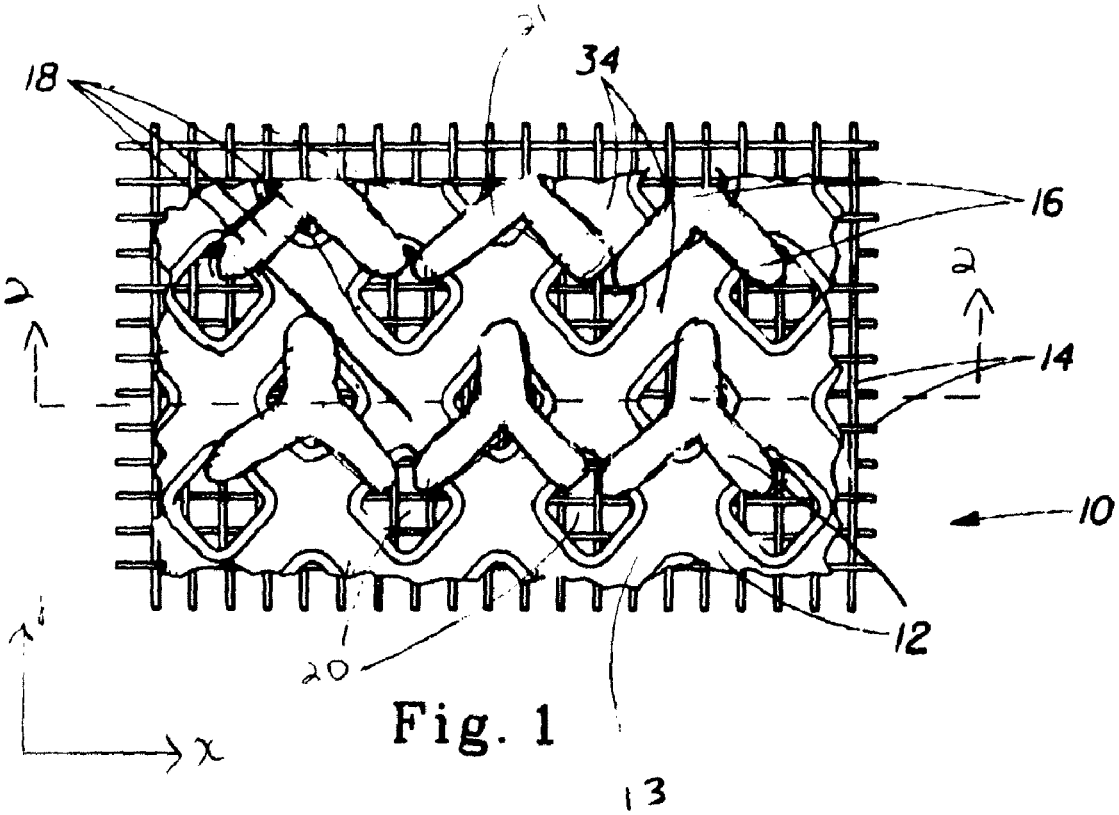
FIG. 1 is a fragmentary top plan view of a papermaking belt, the framework comprising a first layer comprising a continuous patterned network defining a plurality of discrete deflection conduits and the second layer comprising discrete protuberances, according to the present invention.

As used herein, "paper product" refers to any formed, fibrous structure products, traditionally, but not necessarily, comprising cellulose fibers. In one embodiment, the paper products of the present invention include tissue-towel paper products. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers. If more than one layer is used, it is not necessary for each layer to be made from the same fibrous structure. Further, the layers may or may not be homogenous within a layer. The actual makeup of a tissue paper ply is generally determined by the desired benefits of the final tissue-towel paper product, as would be known to one of skill in the art.

The term "fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

Referring to FIGS. 1-9, the papermaking belt 10 according to the present invention is useful for papermaking. The papermaking belt 10 may be used as a through air drying belt, a forming wire, a backing wire for a twin wire former, a transfer belt, or, with appropriate batting, as a press felt, etc. Except as noted, the following discussion is directed to a through air drying belt although the foregoing executions are contemplated to be within the scope of the invention. The belt 10 may also be used in a crescent former where the belt 10 acts as both a backing wire and a through air drying belt or press felt.

In one embodiment the first layer 13 and the second layer 16 of the belt 10 according to the present invention are macroscopically monoplanar and/or non-monoplanar. The plane of the papermaking belt 10 defines the X-Y directions. Perpendicular to the X-Y directions and the plane of the papermaking belt 10, is the Z-direction of the belt 10. The thickness of the belt 10, "T", is from about 15 mils to about 100 mils, in another embodiment from about 25 mils to about 60 mils.

The belt 10 comprises two components: a framework 12 and a reinforcing element 14. The framework 12 may comprise any suitable material, including, without limitation, a resinous material (such as, for example, a photosensitive resin), plastic, metal, metal-impregnated polymers, molded or extruded thermoplastic or pseudo-thermoplastic material, and in one embodiment comprises a cured polymeric photosensitive resin. If a photosensitive resin is used, in one embodiment the resin, when cured, should have a hardness of no more than about 60 Shore D. The hardness is measured on an unpatterned photopolymer resin coupon measuring about 1 inch by 2 inches by 0.025 inches thick cured under the same conditions as the framework. The hardness measurement is made at 85 degrees Centigrade and read 10 seconds after initial engagement of the Shore D durometer probe with the resin. Suitable photosensitive resins include polymers which cure or cross-link under the influence of radiation, e.g. see U.S. Pat. No. 4,514,345 issued Apr. 30, 1985 to Johnson et al.

The framework 12 has a first layer 13 and a second layer 16. The first layer 13 has a top surface 34 and a bottom surface 35. The second layer 16 also has a top surface 18 and a bottom surface 19. In one embodiment the top surface 34 of the first layer 13 and the top surface 18 of the second layer 16 defines the paper contacting side of the belt 10 and an opposed backside 25 of the framework 12 oriented towards the papermaking machine on which the belt 10 is used. In one embodiment the second layer 16 extends above the top surface 34 of the first layer 13 a distance of "t", which is from about 5 mils to about 40 mils, in another embodiment from about 10 mils to about 30 mils, and in another embodiment from about 15 mils to about 25 mils. The thickness of the first layer (t1) is from about 10 mils to about 60 mils, in another embodiment from about 15 mils to about 40 mils, and in another embodiment from about 30 mils to about 40 mils.

The first layer 13 and the second layer 16 of the framework 12 defines the papermaking contacting side of the belt 10. In one embodiment the framework 12 defines a predetermined pattern, which imprints a like pattern onto the paper web made therefrom. Discrete isolated deflection conduits 20 extend between the a top surface 34 and a bottom surface 35 of the first layer 13.

Extending in the Z direction above the top surface 34 of the first layer 16 of the belt 10, are a plurality of discrete protuberances 21 forming the second layer 16. The discrete protuberances 21 may be of any shape or size. In one embodiment the discrete protuberances 21 of the second layer comprise closed figures at a frequency of from about 10/inch2 to about 250/in2, in another embodiment from about 20/inch2 to about 100/in2. The top surface 18 of the second layer 16 comprises a surface area of from about 10% to about 45%, in another embodiment from about 15% to about 35%, in another embodiment from about 20% to about 30%, of the total surface area of the reinforcing element. The total projected (paper contacting) surface area of the top surfaces of the first layer 13 and second layer 16 is from about 10% to about 80%, in another embodiment from about 15% to about 55%, and in another embodiment from about 20% to about 45%, of the total surface area of the reinforcing element.

The machine side 26 of the belt 10 may be the machine facing side 24 of the reinforcing element 14, the bottom surface 35 of the first layer 13 and/or the bottom surface 19 of the second layer 16, or combinations thereof. The machine facing side 24 of the reinforcing element 14 of the belt 10, is, in one embodiment, the machine contacting surface of the belt 10. The reinforcing element 14 may have a network with passageways therein which are distinct from the deflection conduits. The passageways of the reinforcing element 14 may provide irregularities in the texture of the backside of the belt 10. These irregularities allow for air leakage in the X-Y plane of the belt 10, which leakage does not necessarily flow in the Z-direction through the deflection conduits of the belt 10.

The belt 10 according to the present invention comprises a reinforcing element 14. The reinforcing element 14, like the framework 12, has a paper facing side 23 and a machine facing side 24 that is opposite the paper facing side. The reinforcing element 14 may be primarily disposed between the opposed surfaces of the belt 10 and may have a surface coincident the backside of the belt 10. The reinforcing element 14 provides support for the framework 12.

In one embodiment the reinforcing element 14 is woven. In addition to woven fabric, the reinforcing element 14, may be a nonwoven element, wire mesh, screen, net, press felt or a plate or film having a plurality of holes therethrough or other material that may provide adequate support and strength for the framework 12 of the present invention. Suitable reinforcing elements 14 may be made according to commonly assigned U.S. Pat. Nos. 5,496,624, issued Mar. 5, 1996 to Stelljes, et al., 5,500,277 issued Mar. 19, 1996 to Trokhan et al., and 5,566,724 issued Oct. 22, 1996 to Trokhan et al. The reinforcing element 14 may be fluid-permeable, fluid-impermeable, or partially fluid-permeable (meaning that some portions of the reinforcing element may be fluid-permeable, while other portions thereof may be not).

In one embodiment, the reinforcing element 14 has a thickness of from about 10 mils to about 50 mils. In one embodiment, the reinforcing element has a thickness of from about 26 mils to about 30 mils when t1 is from about 13 mils to about 34 mils. In another embodiment, the reinforcing element has a thickness of from about 38 mils to about 42 mils when t1 is from about 19 mils to about 46 mils.

Portions of the reinforcing element 14 may be registered with the deflection conduits to prevent fibers used in papermaking from passing completely through the deflection conduits, and thereby reduce the occurrences of pinholes in the paper made therewith.

Figure 2:
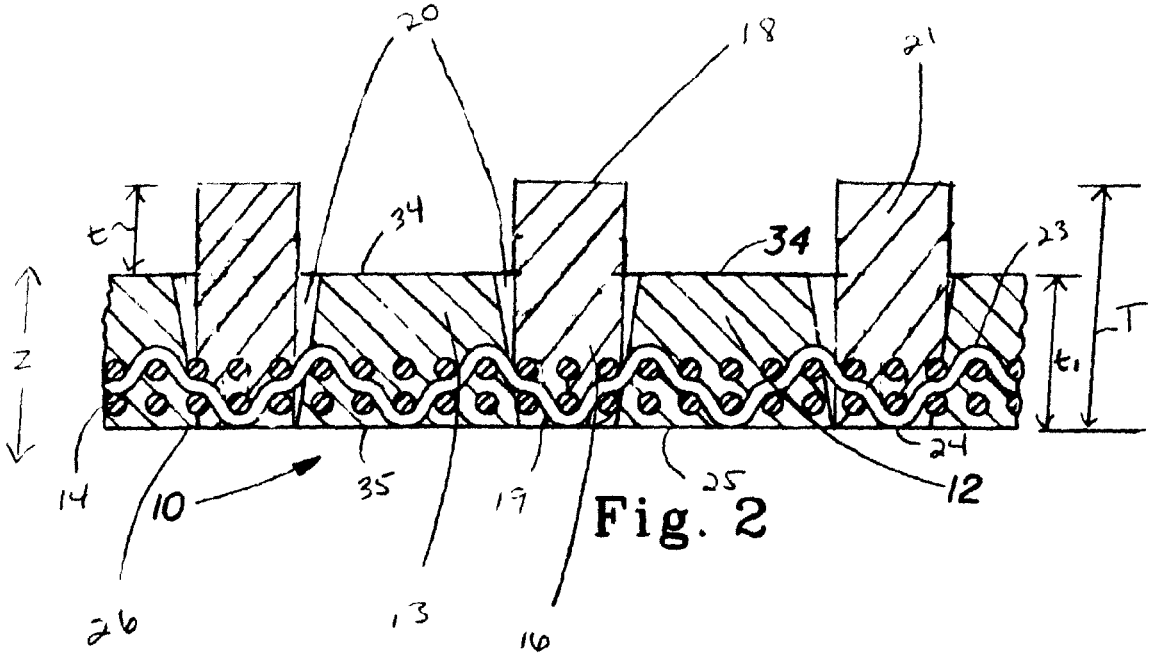
FIG. 2 is an offset vertical sectional view of the belt of FIG. 1 taken along lines 2-2, where the second layer completely penetrates the reinforcing element.

As shown in FIGS. 1-2, in one embodiment of the present invention, the framework 12 comprises a first layer 13 comprising a substantially continuous patterned network defining a plurality of discrete isolated deflection conduits 20 therewithin. The first layer 13 borders and defines the discrete isolated deflection conduits 20 (also referred to as discontinuous deflection conduits). The perimeter of each of the discrete isolated deflection conduits 20 defines a polygon wherein the deflection conduits 20 are distributed in a repeating array. In one embodiment the polygon has less than seven sides, in another embodiment has less than 6 sides. In one embodiment the polygons have a frequency of from about 10/inch2 to about 250/in2, in another embodiment from about 50/inch2 to about 150/in2. In one embodiment the repeating array is a bilaterally staggered array. The second layer 16 fully penetrates the reinforcing element 14, around the first layer 13. Extending in the Z direction above the top surface 34 of the first layer 13 of the belt 10, are a plurality of discrete protuberances 21. FIG. 2 is an offset vertical sectional view of the belt of FIG. 1 taken along lines 2-2, where the second layer 16 completely penetrates at least some of the reinforcing element 14.

In one embodiment the surface area of the top surface 18 of discrete protuberances 21, is between about 5% and about 50%, in another embodiment from about 10% to about 40%, and in another embodiment from about 15% to about 25% of the total surface area of the reinforcing element or the surface area of the paper facing side of the reinforcing element.

Figure 3:
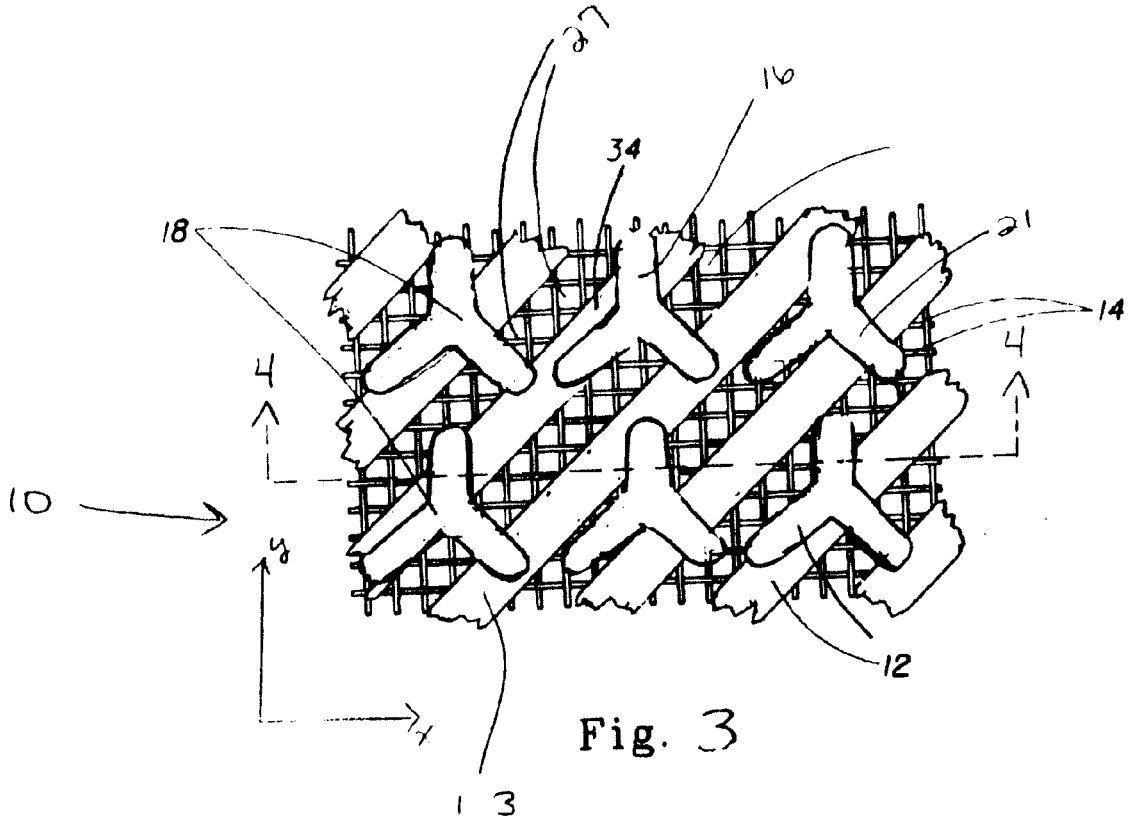
FIG. 3 is a fragmentary top plan view of a papermaking belt, the framework comprising a first layer comprising a semi-continuous patterned network defining a plurality of semi-continuous deflection conduits and the second layer comprising discrete protuberances according to the present invention.
Figure 4:
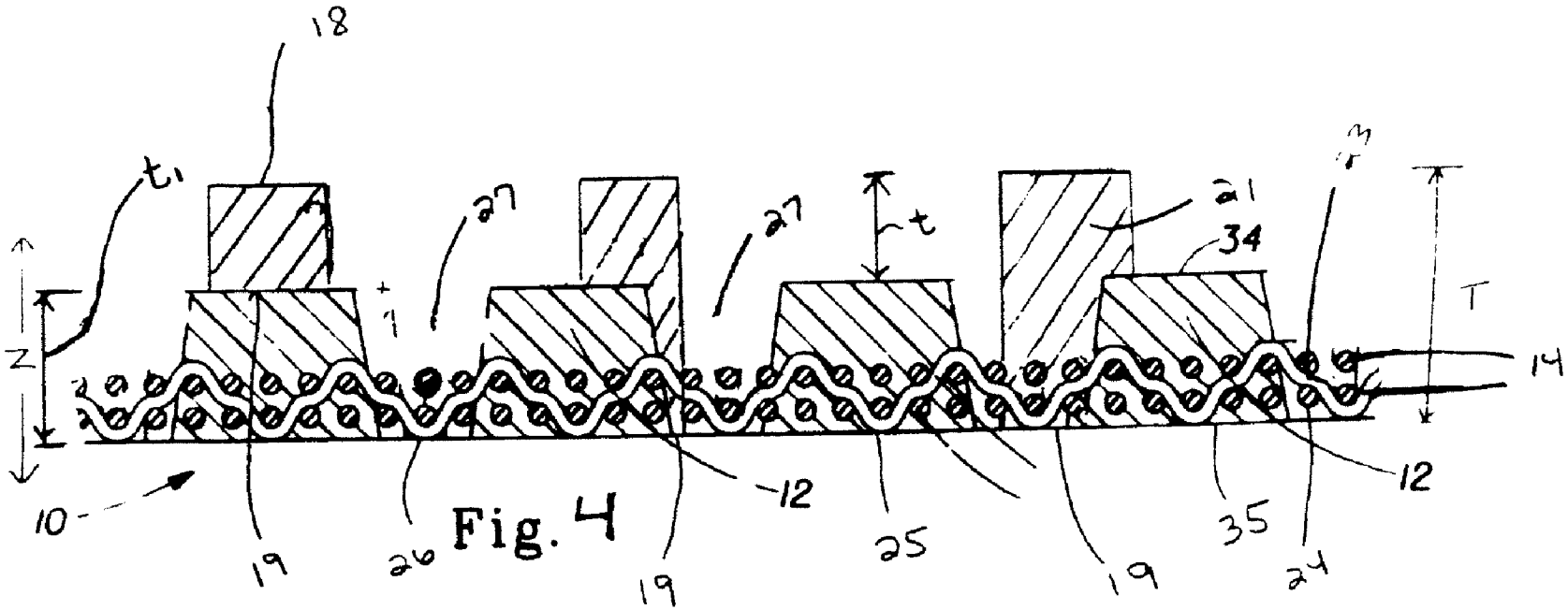
FIG. 4 is an offset vertical sectional view of the belt of FIG. 3 taken along lines 1/I, where the second layer completely penetrates the reinforcing element.

As shown in FIGS. 3-4, in one embodiment of the present invention, the framework 12 comprises a first layer 13 comprising a substantially semi-continuous patterned network defining a plurality of semi-continuous deflection conduits 27 therewithin. The first layer 13 borders and defines the semi-continuous deflection conduits 27. The second layer 16 fully penetrates at least some of the reinforcing element 14 around the first layer 13. Extending in the Z direction above the top surface 34 of the first layer 13 of the belt 10, are a plurality of discrete protuberances 21. FIG. 4 is an offset vertical sectional view of the belt of FIG. 3 taken along lines 4-4, where the second layer 16 completely penetrates the reinforcing element 14.

Figure 5:
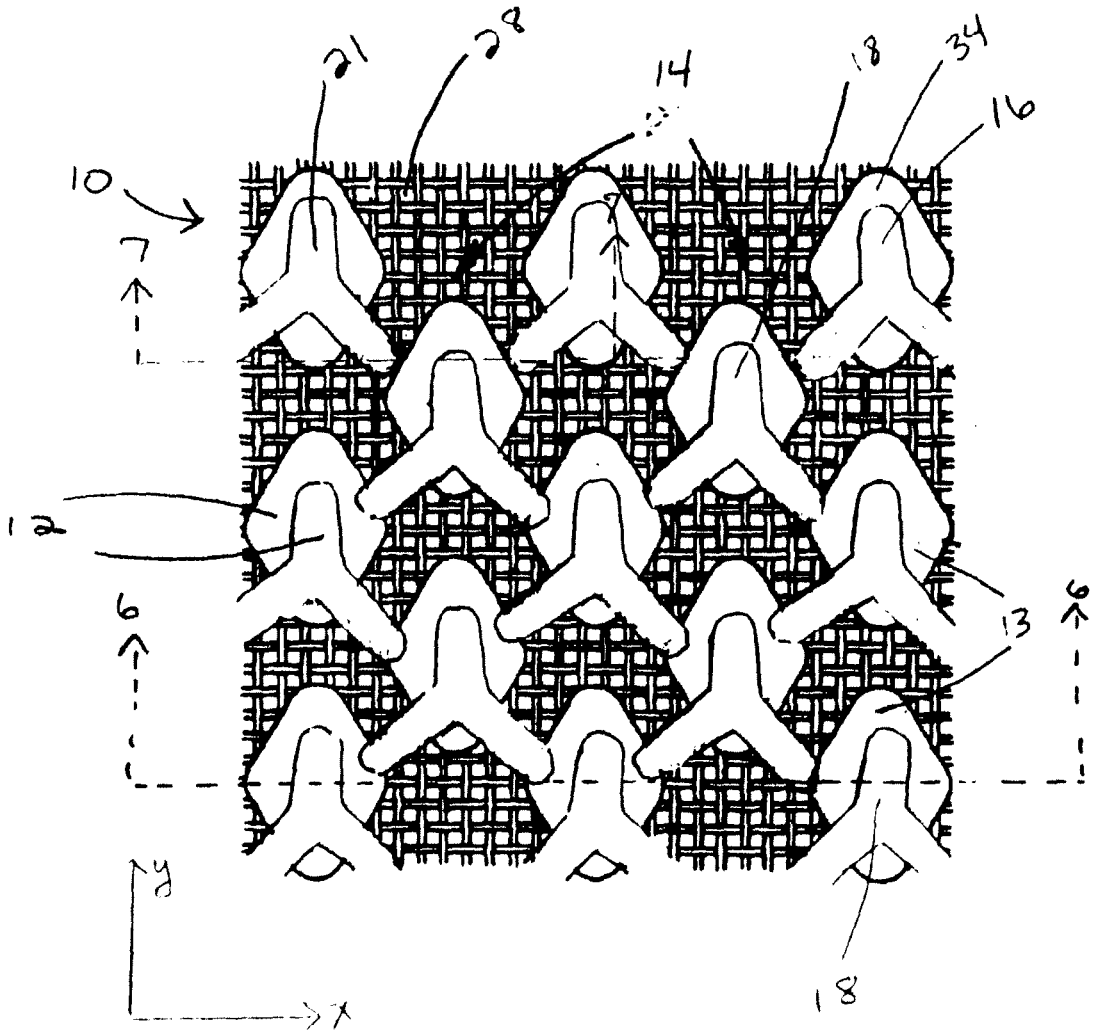
FIG. 5 is a fragmentary top plan view of a papermaking belt, the framework comprising a first layer comprising a discontinuous patterned network and the second layer comprising discrete protuberances, the first layer and second layer together defining a plurality of discontinuous isolated discrete deflection conduits according to the present invention.
Figure 6:
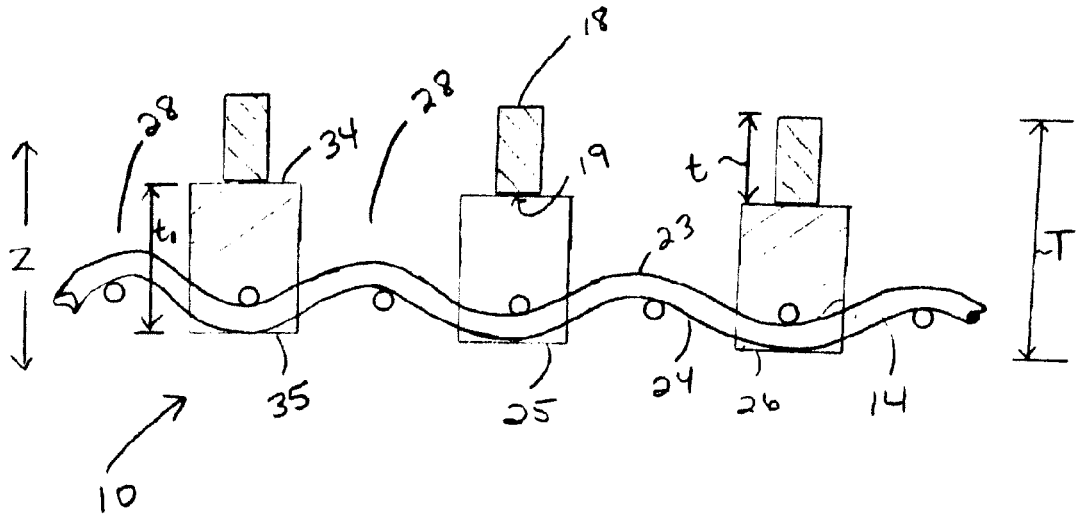
FIG. 6 is an offset vertical sectional view of the belt of FIG. 5 taken along lines 6-6.
Figure 7:
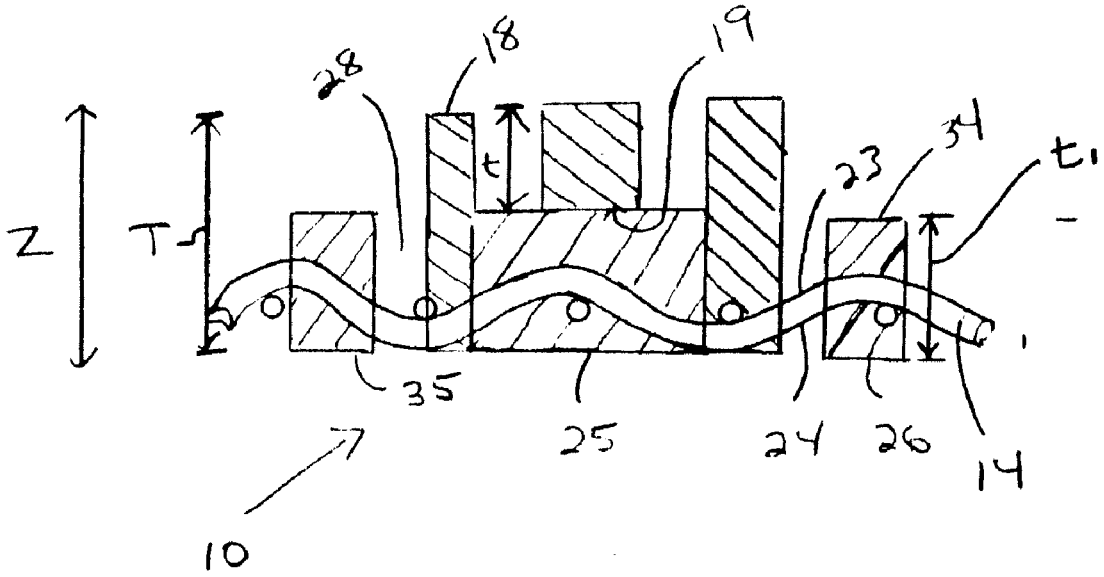
FIG. 7 is an offset vertical sectional view of the belt of FIG. 5 taken along lines 7-7.

As shown in FIGS. 5-7, in one embodiment of the present invention, the framework 12 comprises a first layer 13 comprising a discrete isolated patterned network (also called herein "discontinuous network") and a plurality of discrete protuberances 21 as the second layer 16, together defining a plurality of discontinuous discrete isolated deflection conduits 28. In one embodiment the first and second layers of the framework 12 borders and defines the discontinuous deflection conduits 28. The second layer 16 fully penetrates at least some of the reinforcing element 14, around the first layer 13. Extending in the Z direction above the top surface 34 of the first layer 13 of the belt 10, are a plurality of discrete protuberances 21. FIG. 6 is an offset vertical sectional view of the belt of FIG. 5 taken along lines 6-6. FIG. 7 is an offset vertical sectional view of the belt of FIG. 5 taken along lines 7-7.

Figure 8:
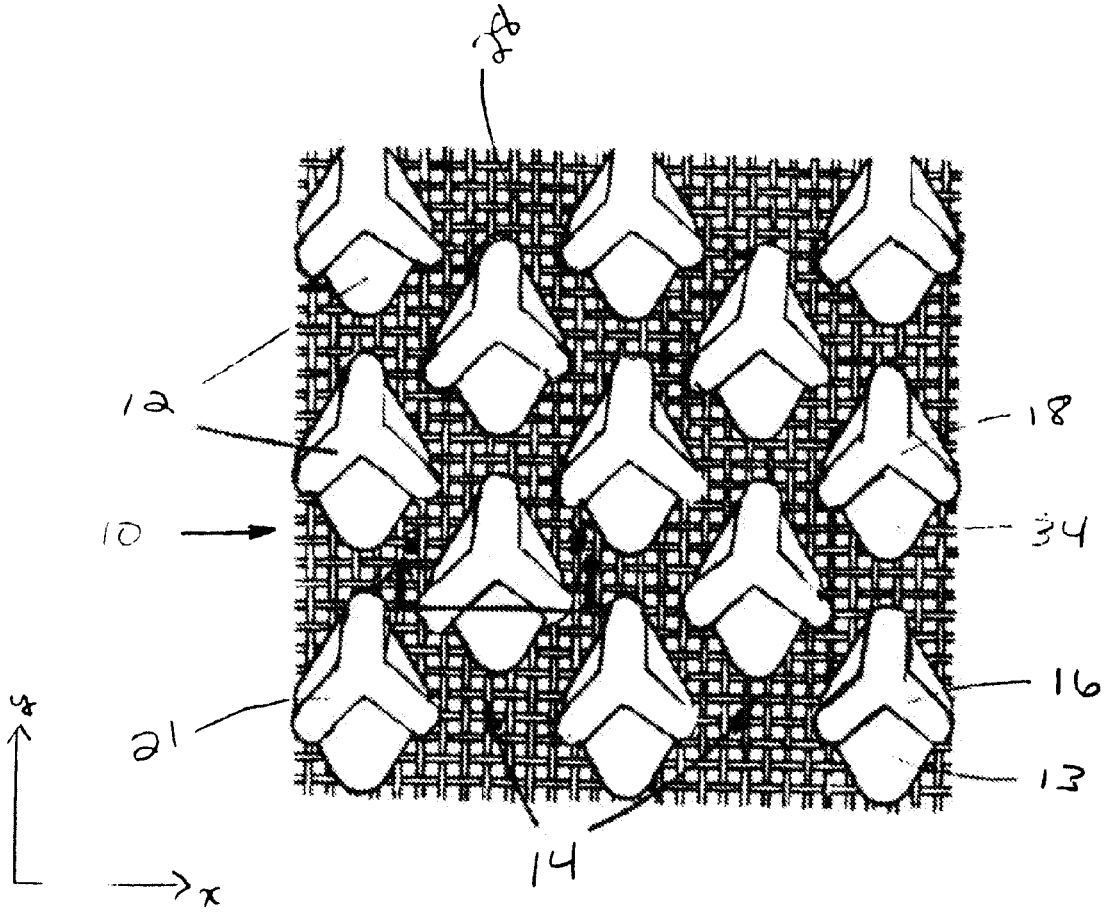
FIG. 8 is a fragmentary top plan view of a papermaking belt, the framework comprising a first layer comprising a discontinuous patterned network defining continuous deflection conduits and the second layer comprising discrete protuberances, according to the present invention.
Figure 9:
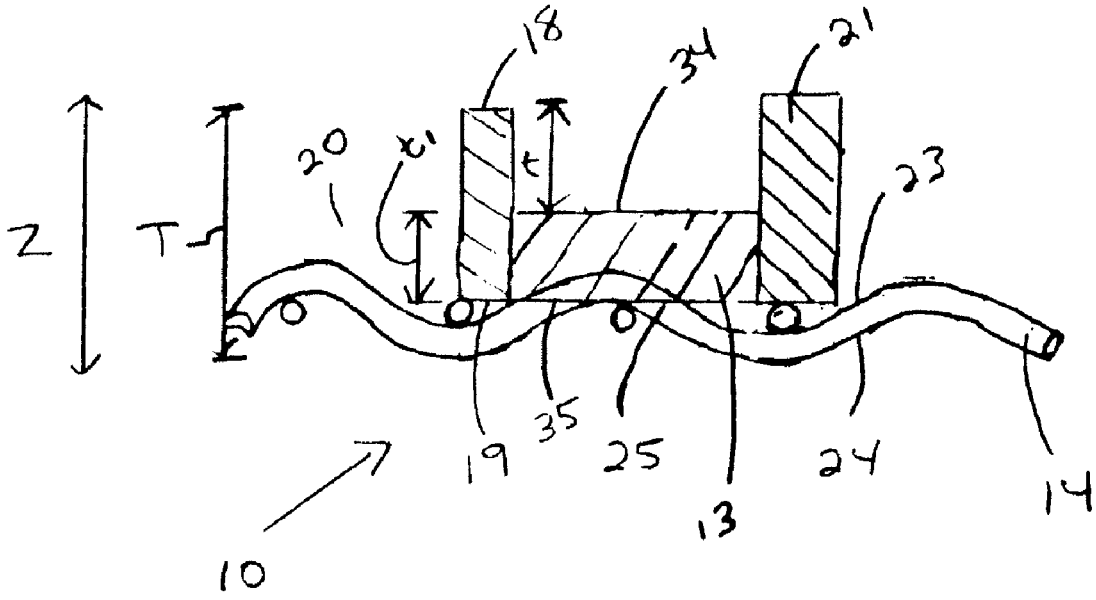
FIG. 9 is an offset vertical sectional view of the belt of FIG. 8 taken along lines 8-8.

As shown in FIGS. 8-9, in one embodiment of the present invention, the framework 12 comprises a first layer 13 comprising a discrete isolated patterned network (also called herein "discontinuous network") defining continuous deflection conduits 29. The framework 12 borders and defines the continuous deflection conduits 29. The second layer 16 partially penetrates the reinforcing element 14 around the first layer 13. Extending in the Z direction above the top surface 34 of the first layer 13 of the belt 10, are a plurality of discrete protuberances 21.

The paper made with the belts according to the present invention may be through-air dried or conventionally dried as taught in any of commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; 5,628,876 issued May 13, 1997 to Ayers et al.; 5,679,222 issued Oct. 21, 1997 to Rasch et al.; 5,714,041 issued Feb. 3, 1998 to Ayers et al.; and 5,906,710, issued May 25, 1999 to Trokhan.

The paper made with the belts disclosed herein may optionally be foreshortened, as is known in the art. Foreshortening can be accomplished by creping the paper from a rigid surface, and in one embodiment from a cylinder. A Yankee drying drum is commonly used for this purpose. Creping is accomplished with a doctor blade as is well known in the art. Creping may be accomplished according to commonly assigned U.S. Pat. No. 4,919,756, issued Apr. 24, 1992 to Sawdai. Alternatively or additionally, foreshortening may be accomplished via wet microcontraction as taught in commonly assigned U.S. Pat. No. 4,440,597, issued Apr. 3, 1984 to Wells et al.

A first layer 13 that forms a semi-continuous patterned network may be straight, sinusoidal or otherwise undulating.

In one embodiment the belts of the present invention do not comprise suspended portions elevated in the Z-direction from the x-y plane to create cantilever portions that create void spaces between the x-y plane and the suspended cantilever portions, as disclosed in U.S. Pat. No. 6,576,091, issued Jun. 10, 2003, Cabell et al.

The papermaking belt, in one embodiment, has an air permeability of between about 200 and about 800 standard cubic feet per minute (scfm), where the air permeability in scfm is a measure of the number of cubic feet of air per minute that pass through a one square foot area of the papermaking belt at a pressure drop across the thickness of the papermaking belt 10 equal to about 0.5 inch of water. The air permeability may be measured using a Valmet permeability measuring device (Model Wigo Taifun Type 1000) available from the Valmet Corporation of Pansio, Finland.

In one embodiment the papermaking belt has the air permeability listed above so that the belt may be used with a paper making machine having a vacuum transfer section and a through air drying capability, as described herein.

The reinforcing element 14, in one embodiment, has between about 25 filaments and about 100 filaments per inch measured in the cross machine direction and between about 25 filaments and about 100 filaments per inch measured in the machine direction, where the filaments have, in one embodiment, a diameter between about 0.1 millimeter and about 0.5 millimeter, in another embodiment between about 0.15 millimeter and about 0.28 millimeter. The reinforcing element in one embodiment comprises between about 625 and about 10,000 discrete web contacting knuckles per square inch of the projected area of the reinforcing element. In one embodiment the reinforcing element has a thickness from about 28 mils to about 40 mils.

The filaments for use in the reinforcing element may be formed from a number of different materials. Suitable filaments and filament weave patterns for forming the reinforcing element are disclosed in U.S. Pat. No. 4,191,609 issued Mar. 4, 1980 to Trokhan, and U.S. Pat. No. 4,239,065 issued Dec. 16, 1980 to Trokhan.

The belts of the present invention may be useful for the production of fibrous structures such as absorbent paper products, other sheet goods, such as nonwoven materials, dryer-added fabric softeners, topsheets/backsheets for disposable absorbent articles such as diapers and sanitary napkins, etc.

Method of Making the Belt

The belt 10 according to the present invention may be made by curing a photosensitive resin through a mask. The mask has first regions which are transparent to actinic radiation and second regions which are opaque to the actinic radiation. The regions in the mask which are transparent to the actinic radiation will form like regions in the photosensitive resin which cure and become the framework 12 of the belt 10 according to the present invention. Conversely, the regions of the mask which are opaque to the actinic radiation will cause the resin in the positions corresponding thereto to remain uncured. This uncured resin is removed during the beltmaking process and does not form part of the belt 10 according to the present invention.

The belt of the present invention may be formed by a process comprising the following steps:

providing a coating of a liquid curable material, in one embodiment a liquid photosensitive resin, supported by a forming surface, the coating having a first thickness;

providing a source of curing radiation;

providing a first mask having a pre-selected pattern of transparent regions and opaque regions therein and positioning the first mask between the coating of the curable material and the source of curing radiation so that the opaque regions of the first mask shield areas of the coating from the curing radiation while the transparent regions of the first mask cause other areas of the coating to be unshielded;

curing the unshielded areas of the coating by exposing the coating to the curing radiation through the first mask while leaving the shielded areas of the coating uncured, thereby forming a partly-cured first layer;

removing substantially all uncured liquid curable material from the partly-formed first layer to leave a hardened or semi-hardened material structure;

providing a second coating of a liquid curable material, in one embodiment a liquid photosensitive resin, to the partly-formed first layer, the second coating having a second thickness;

providing a source of curing radiation;

providing a second mask having a pre-selected pattern of transparent regions and opaque regions therein, in one embodiment the pattern is different from the first mask, and positioning the second mask between the second coating of the curable material and the source of curing radiation so that the opaque regions of the second mask shield areas of the second coating from the curing radiation while the transparent regions of the second mask cause other areas of the second coating to be unshielded;

curing the unshielded areas of the second coating by exposing the second coating to the curing radiation through the second mask while leaving the shielded areas of the second coating uncured, thereby forming a partly or fully-cured second layer;

removing substantially all uncured liquid curable material from the partly-cured or fully cured second layer to leave a hardened material or semi-hardened material structure.

In one embodiment the process further comprises an additional curing step of:

further curing the unshielded areas of the first and second coating by exposing the first and second coating to a second source of curing radiation, thereby forming a fully-cured first layer and second layer, to leave a hardened resinous structure.

In one embodiment the first coating thickness and the second coating thickness are the same. In another embodiment the first coating thickness and the second coating thickness are different.

In one embodiment, a backing film may be provided and positioned between the forming surface and the coating of a liquid photosensitive resin, to protect the forming surface from being contaminated by the liquid resin.

If the papermaking belt having a reinforcing element is desired, the process may further include steps of providing a suitable reinforcing element supported by the forming surface, the reinforcing element having a paper facing side and a machine facing side, and depositing the first or second coating of a liquid photosensitive resin to the paper facing side of the reinforcing element.

In one embodiment, a backing film may be provided and positioned between the reinforcing element and the first coating of a liquid photosensitive resin, to protect the reinforcing element from being contaminated by the liquid resin.

The thickness of the coating can be controlled by, for example, a roll, a bar, a knife, or any other suitable means known in the art.

In one embodiment, the first step in the process comprising making a belt 10 is to make the belt with the first layer 13 via a process and pattern known in the art. For example, papermaking belts having a single layer of continuous patterned network to form the first layer of the framework and discrete deflection conduits are illustrated in commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; and, 5,679,222 issued Oct. 21, 1997 to Rasch et al. Likewise, a belts having a single layer that forms a semi-continuous patterned network and semi-continuous deflection conduits may be made according to the teachings of commonly assigned U.S. Pat. Nos. 5,628,876, issued May 13, 1997 to Ayers, et al. and 5,714,041 issued Feb. 13, 1998 to Ayers, et al. Also, belts having a single layer that forms discontinuous patterned network and continuous deflection conduits may be produced in accordance with commonly assigned U.S. Pat. Nos. 4,514,345, issued Apr. 30, 1985 to Johnson, et al.; 5,245,025, issued Sep. 14, 1993 to Trokhan et al.; 5,527,428 issued Jun. 18, 1996 to Trokhan et al.; 5,534,326 issued Jul. 9, 1996 to Trokhan et al.; 5,654,076, issued Aug. 5, 1997 to Trokhan et al.; 5,820,730, issued Oct. 13, 1998 to Phan et al.; 5,277,761, issued Jan. 11, 1994 to Phan et al.; 5,443,691, issued Aug. 22, 1995 to Phan et al.; 5,804,036 issued Sep. 8, 1998 to Phan et al.; 5,503,715, issued Apr. 2, 1996 to Trokhan et al.; 5,614,061, issued Mar. 25, 1997 to Phan et al.; and 5,804,281 issued Sep. 8, 1998 to Phan et al. and U.S. Pat. No. 6,171,447, issued Jan. 9, 2001, to Trokhan.

In one embodiment, the top surface of the first layer is maintained in a partially uncured condition to enable the second layer to join together with the first layer upon contact therebetween.

A mask may be used in the process of making the belt herein, for curing the curable material, such as, for example, a photosensitive resinous material, suitable for making the papermaking belt of the present invention. In one embodiment, the mask comprises a structure having a top side and a bottom side opposite to the top side, and a pattern of transparent regions and opaque regions. The transparent regions and the opaque regions may comprise a non-random and repeating pattern. The opaque regions may comprise a substantially continuous network pattern, a substantially semi-continuous network pattern, a pattern formed by a plurality of discrete areas, or any combination thereof.

In one embodiment the mask used herein to make the first layer of the belt, comprises transparent regions and opaque regions wherein the opaque regions may be selected to form a papermaking belt comprising a substantially continuous, a substantially semi-continuous, and/or a substantially discontinuous, patterned network, and wherein the mask used to make the second layer comprises transparent regions and opaque regions wherein the opaque regions may be selected to form a papermaking belt comprising discrete protuberances.

In its industrial application, each of the processes of making the papermaking belt, described herein, can comprise a continuous process. For example, the continuous process of making the papermaking belt, comprises the following steps: providing a coating of a liquid curable material supported by a forming surface, and continuously moving the forming surface with the coating in a machine direction, the coating having a bottom surface facing the forming surface, a top surface opposite to the bottom surface, and a first thickness defined between the top and bottom surfaces;

providing a source of curing radiation structured and configured to emit a curing radiation to continuously cure the coating supported by the forming surface moving in the machine direction;

continuously providing a transparent first mask;

continuously printing the first mask to form a first pattern of opaque regions therein;

continuously moving the first mask having the pattern of opaque regions to position the first masks between the coating and the source of curing radiation;

continuously curing the curable material, wherein the opaque regions of the pattern at least partially shield areas of the curable material from the curing radiation such that the areas are cured through at least a portion of the first thickness of the coating, thereby forming the first layer of a partly-formed papermaking belt; and continuously removing substantially all uncured material from the partly-formed papermaking belt to leave a hardened material or resinous structure;

providing a second coating of a liquid curable material supported by the first layer, and continuously moving the first layer with the second coating in a machine direction, the second coating having a bottom surface facing the first layer, a top surface opposite to the bottom surface, and a second thickness defined between the top and bottom surfaces;

providing a source of curing radiation structured and configured to emit a curing radiation to continuously cure the second coating supported by the first layer moving in the machine direction;

continuously providing a transparent second mask, in one embodiment the second mask is different than the first mask;

continuously printing the second mask to form a first pattern of opaque regions therein;

continuously moving the second mask having the pattern of opaque regions to position the second mask between the second coating and the source of curing radiation;

continuously curing the curable material, wherein the opaque regions of the pattern at least partially shield areas of the curable material from the curing radiation such that the areas are cured through at least a portion of the second thickness of the second coating, thereby forming the second layer of a partly-formed papermaking belt; and continuously removing substantially all uncured material from the partly-formed papermaking belt to leave a hardened material or resinous structure;

further continuously curing the unshielded areas of the first and second coating by exposing the first and second coating to a second source of curing radiation, thereby forming a fully-cured first layer and second layer, to leave a hardened resinous structure.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

What is claimed is:

1. A papermaking belt for making a fibrous structure comprising:

an X-Y plane, and a thickness extending in a Z-direction perpendicular to the X-Y plane;

a framework comprising:

a first layer and a second layer, each of the first and second layers having a top surface, a bottom surface opposite to the top surface, and the first layer having a plurality of deflection conduits extending in the Z-direction between the top and bottom surfaces of the first layer and structured to receive therein fibers of the fibrous structure; the first layer comprising a substantially continuous, substantially discontinuous or substantially semicontinuous patterned network;

wherein the second layer comprises a plurality of discrete protuberances; and the top surface of the second layer forming the web-side of the framework; and wherein the first layer partially penetrates at least some the reinforcing element;

a reinforcing element comprising:

a paper facing side and a machine facing side opposite to the paper facing side;

wherein the second layer at least partially penetrates the reinforcing element or the bottom surface of the second layer is coplanar with the bottom surface of the first layer.

2. The papermaking belt of claim 1 wherein the first layer and the second layer are non-woven.

3. The papermaking belt of claim 2 wherein the top surface of the first layer and the top surface of the second layer are macroscopically monoplanar or non-monoplanar.

4. The papermaking belt of claim 1 wherein the first layer fully penetrates at least some of the reinforcing element.

5. The papermaking belt of claim 1 wherein the bottom surface of the first layer forms the backside of the framework.

6. The papermaking belt of claim 1 wherein the second layer fully penetrates at least some of the reinforcing element.

7. The papermaking belt of claim 6 wherein the bottom surface of the first layer and the bottom surface of the second layer form the backside of the framework.

8. The papermaking belt of claim 7 wherein the bottom surface of the first layer and the bottom surface of the second layer are coplanar with each other.

9. The papermaking belt of claim 1 wherein the first layer comprises a substantially continuous patterned network defining a plurality of discrete isolated deflection conduits therewithin.

10. The papermaking belt of claim 9 wherein the perimeter of each deflection conduit defines a polygon wherein the deflection conduits are distributed in a repeating array.

11. The papermaking belt of claim 10 wherein the repeating array is a bilaterally staggered array.

12. The papermaking belt of claim 10 wherein the polygon has less than seven sides.

13. The papermaking belt of claim 12 wherein the polygons have a frequency of from about $10/in^2$ to about $250/in^2$.

14. The papermaking belt of claim 13 wherein the polygons have a frequency of from about 50/in2 to about 150/in2.

15. The papermaking belt of claim 1 wherein the first layer comprises a substantially semicontinuous patterned network defining a plurality of semicontinuous deflection conduits therewithin.

16. The papermaking belt of claim 1 wherein the first layer comprises a substantially discontinous patterned network defining a plurality of continuous deflection conduits therewithin.

17. The papermaking belt of claim 1 wherein the discrete protuberances of the second layer define a closed figure having nonlinear sides.

18. The papermaking belt of claim 17 wherein the closed figures comprise a frequency of from about 10/in2 to about 250/in2.

19. The papermaking belt of claim 18 wherein the closed figures comprise a frequency of from about 20/in2 to about 100/in2.

20. The papermaking belt of claim 1 wherein top surface of the second layer comprises a surface area of from about 10% to about 45% of the total surface area of the reinforcing element.

21. The papermaking belt of claim 20 wherein the surface area is about 15% to about 35% of the total surface area of the reinforcing element.

22. The papermaking belt of claim 2 wherein the first and second layers comprise a photosensitive resin.

23. The papermaking belt of claim 22 wherein the photosensitive resin comprises a solid polymeric material which has been rendered solid by exposing a liquid photosensitive resin to light of an activating wavelength.

24. The papermaking belt of claim 1 wherein the papermaking belt is from about 15 mils to about 100 mils thick.

25. The papermaking belt of claim 24 wherein the papermaking belt is from about 25 mils to about 60 mils thick.

26. The papermaking belt of claim 1 wherein the second layer extends above the top surface of the first layer a distance (t) of from about 5 mils to about 40 mils and the thickness of the first layer ($t_1$) is from about 10 mils to about 60 mils.

27. The papermaking belt of claim 26 wherein (t) is from about 15 mils to about 25 mils and ($t_1$) is from about 30 mils to about 40 mils.

28. The papermaking belt of claim 1 having an air permeability of about 200 to about 800 standard cubic feet per minute.

29. The papermaking belt of claim 1 wherein the reinforcing element is a woven element and is fluid permeable.

30. The papermaking belt of clam 1 wherein the reinforcing element has a thickness of from about 26 mils to about 30 mils when ($t_1$) is from about 13 mils to about 34 mils.

31. The papermaking belt of clam 1 wherein the reinforcing element has a thickness of from about 38 mils to about 42 mils when ($t_1$) is from about 19 mils to about 46 mils.

* * * * *

UNITED STATES PATENT AND TRADEMARK OFFICE

CERTIFICATE OF CORRECTION

PATENT NO. : 7,914,649 B2
APPLICATION NO. : 11/925000
DATED : March 29, 2011
INVENTOR(S) : Ward William Ostendorf et al.

It is certified that error appears in the above-identified patent and that said Letters Patent is hereby corrected as shown below:

In Col 2, line 51, the numbers "1/I" should be 4—4.

Signed and Sealed this
Eighth Day of November, 2011

David J. Kappos

David J. Kappos
*Director of the United States Patent and Trademark Office*